United States Patent [19]

Tenney et al.

[11] 3,939,967

[45] Feb. 24, 1976

[54] CONTAINERS FOR PROJECTILES

[75] Inventors: Kenneth S. Tenney, Winchester, Va.; Daniel Tomo, Cincinnati, Ohio

[73] Assignee: National Distillers and Chemical Corporation, New York, N.Y.

[22] Filed: Aug. 1, 1974

[21] Appl. No.: 494,259

[52] U.S. Cl. ..... 206/3; 206/446; 220/4 B; 220/70; 220/284; 220/288

[51] Int. Cl.[2]... F42B 37/02; B65D 11/22; B65D 41/04

[58] Field of Search ..... 206/3; 220/4 B, 4 E, 284, 220/70

[56] References Cited

UNITED STATES PATENTS

| | | | |
|---|---|---|---|
| 816,959 | 4/1906 | Briganti | 220/4 C UX |
| 817,100 | 4/1906 | Bergman | 220/284 |
| 2,061,610 | 11/1936 | Burnette | 220/4 B X |
| 2,383,885 | 8/1945 | Parsons et al. | 220/66 UX |
| 2,927,394 | 3/1960 | Johnson | 220/4 B X |
| 3,095,111 | 6/1963 | Mulder | 220/66 |
| 3,123,205 | 3/1964 | Ehrsam | 206/137 |
| 3,322,262 | 5/1967 | Puente | 220/4 B X |

FOREIGN PATENTS OR APPLICATIONS

| | | | |
|---|---|---|---|
| 946,838 | 1/1964 | United Kingdom | 220/4 B |
| 938,609 | 10/1963 | United Kingdom | 220/66 |

*Primary Examiner*—Leonard Summer
*Attorney, Agent, or Firm*—Kenneth D. Tremain

[57] ABSTRACT

A molded two-part moisture and shock proof container produced from polymeric material intended for the packaging, storage and shipment of projectiles. Each half of the container has a substantially cylindrical configuration with an enlarged open mouth and the exterior surfaces include uniformly spaced longitudinally extending ribs; one half is exteriorly threaded adjacent the open mouth thereof for threaded engagement within the interiorly threaded portion of the mating half of the container. A novel method of exterior banding is provided so that assemblies of multiple containers may be produced. The top and bottom surfaces of the container are provided with concentric annular ribs for the reception of a disengaging tool to permit convenient separation of the container halves.

5 Claims, 12 Drawing Figures

FIG. 5
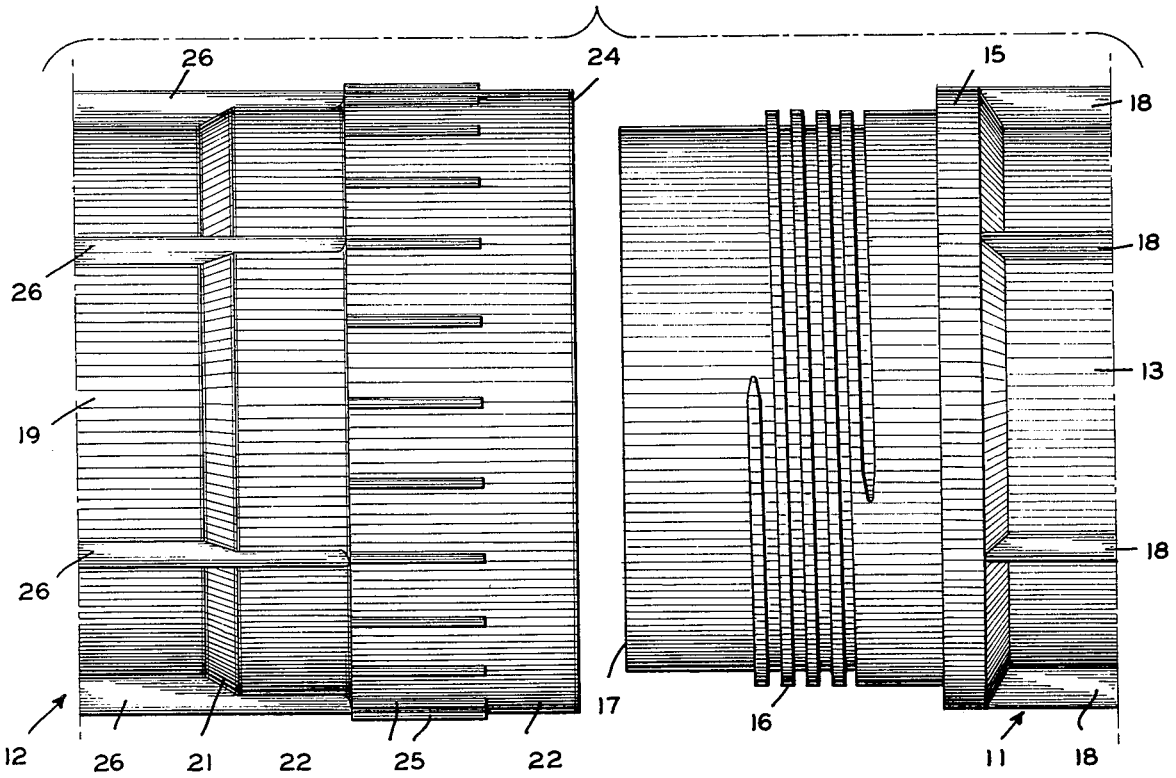
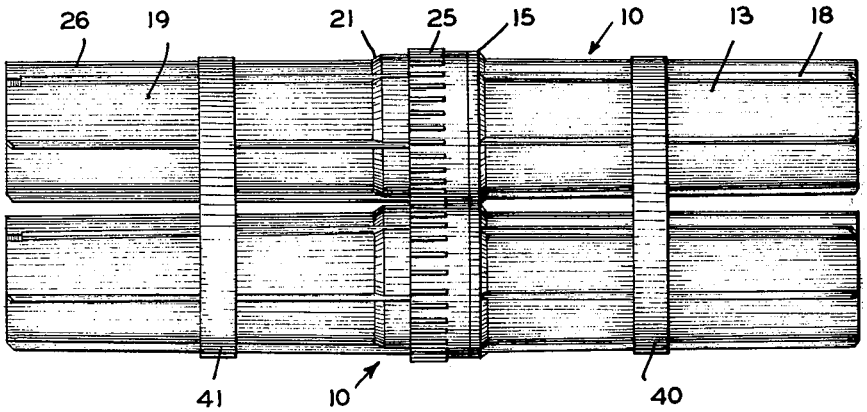
FIG. 6
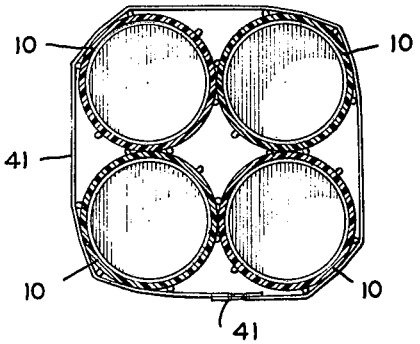
FIG. 7

CONTAINERS FOR PROJECTILES

This invention relates to containers for projectiles such as shells, rockets, or the like. It is essential that such containers be both airtight and waterproof to insure the protection of the contained item(s) of ordnance against deterioration, either during shipment or storage, particularly by reason of the injurious effects of moisture. Additionally, it is required not only that the contained items be retained securely in position, and safeguarded against adverse vibratory influences, but also that there be ready access to the contents and no impediment or interference with the rapid removal of the projectile from the confines of the container.

In connection with ordnance of the character with which we here are concerned, to avoid any necessity for the individual handling of each container, it is highly desirable that the configuration of the containers be such as to permit the assembly of a predetermined and limited number thereof as a unit in mating relationship thereby permitting the convenient storage and removal therefrom, for shipping or other purposes, of such units and avoiding the necessity for the individual handling of each receptacle and contained item of ordnance.

Accordingly, it is a major object of this invention to provide a novel and improved container for the storing and shipment of items of ordnance which will insure the protection of the contained projectile against damage or deterioration.

It is a further object of the invention to provide a container of the character with which we here are concerned which will be relatively light weight and can be produced from nonconductive materials, as by a holding operation, with particular economy.

It is a still further object of the invention to provide a container for items of ordnance, or the like, which will have non-deformable characteristics thereby insuring against any distortion except under extremely abnormal circumstances and which may be reused repeatedly if desired.

Further objects and advantages of the invention will be readily apparent from the following Specification, taken in conjunction with the accompanying drawings, wherein:

FIG. 5 is a fragmentary elevational, view on an enlarged scale, illustrating the mating extremities of the top and bottom portions of the container in disassembled relationship;

FIG. 6 is an elevational view illustrating four containers banded together for handling or storage as a single unit;

FIG. 7 is a transverse sectional view taken on the line 7—7 of FIG. 6 and looking in the direction of the arrows;

Figure 1:
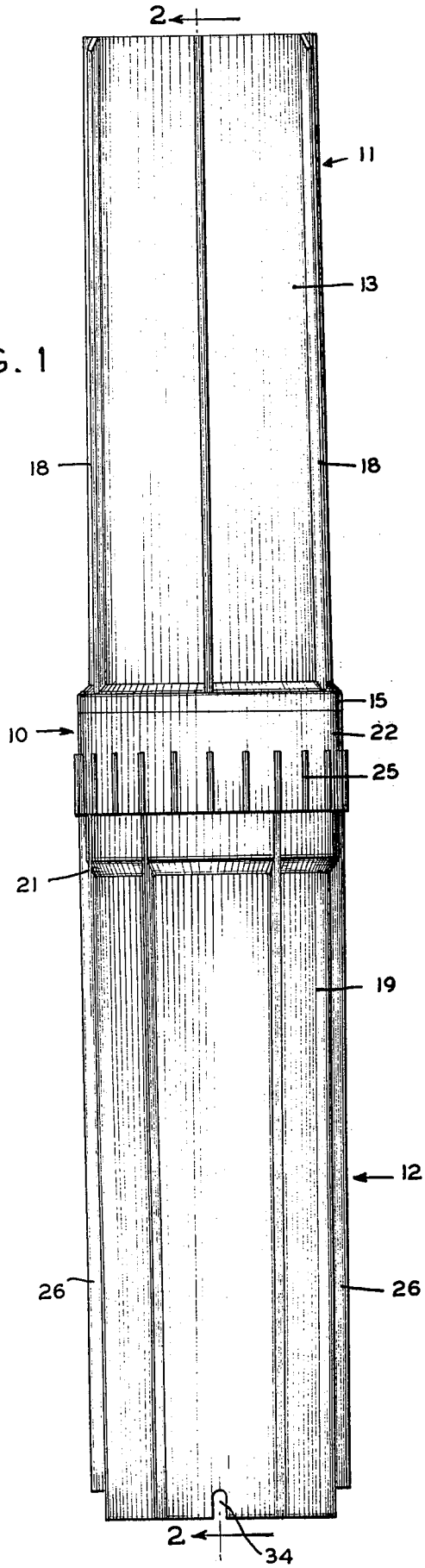
FIG. 1 is a front elevational view of a novel container for items of ordnance, or the like, constructed in accordance with the present invention.

As shown in the drawings, the novel ordnance or projectile container of the present invention, indicated generally at 10, preferably is produced by a molding operation from suitable thermoplastic material. Polyethylene (both linear, high and low density), polypropylene, and related polymeric resins, can be utilized to advantage. For improved characteristics, such as weatherability, impact resistance, stress crack resistance, and the like, crosslinkable polyethylene is particularly desirable.

Other materials including thermosetting compounds such as hard rubber, chenolics, etc., also may be utilized.

Figure 2:
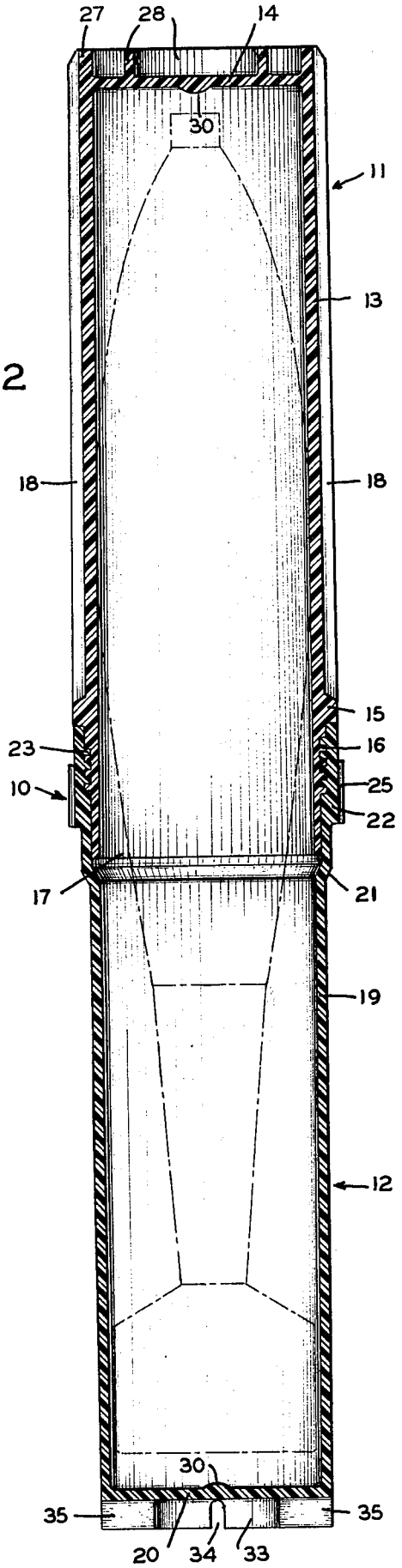
FIG. 2 is a vertical sectional view of the container taken of the line 2—2 of FIG. 1 and looking in the direction of the arrows.

Each container 10 includes upper and lower mating portions 11 and 12 and, as shown more particularly in FIGS. 2 and 5 of the drawings, the upper or top portion 11 includes a substantially cylindrical wall portion 13 open at the lower end and provided with a closed end wall 14 at the other extremity thereof.

The top portion 11 also is provided with an outwardly projecting peripheral rib 15 spaced from the lower or open extremity thereof and the peripheral surface of said top portion includes an externally threaded portion 16 located intermediate said peripheral rib and the mouth 17 of said top portion. A plurality of uniformly spaced and longitudinally extending reinforcing ribs 18 are provided on the exterior surface of said top portion and these ribs extend exteriorly of the top portion from the closed end thereof to the peripheral rib 15. Desirably the diameter of said top portion increases slightly from top to bottom thereof and the interior cavity is similarly tapered.

The bottom portion 12 of the container includes a cylindrical wall portion 19 open at the upper end and provided with a closed end wall 20 at the other extremity thereof. The cylindrical wall portion 19 is flared outwardly as indicated at 21 to provide an upper extremity 22 of slightly increased diameter complementary to and substantially identical to that of the peripheral rib 15 on the upper portion of the container and said upper portion or extremity 22 is provided with an interiorly threaded portion 23 for the reception of the complementarily threaded portion 16 of the upper portion of the container.

The peripheral surface of the upper extremity 22 is provided, intermediate the flared portion 21 and the open mouth 24 of the bottom portion of the container, with a plurality of uniformly and relatively closely spaced small ribs 25 and the exterior surface of said bottom portion is provided with a plurality of uniformly spaced and longitudinally extending rein-forcing ribs 26 similar to the ribs 18 on the upper portion of the container. Desirably the diameter of the bottom portion increases slightly from the bottom to the enlarged upper portion thereof and the interior cavity is similarly tapered.

It will be understood that the longitudinally extending reinforcing ribs 18 and 26 serve the additional utilitarian functions of permitting the convenient and secure grasping of both the assembled container and the mating halves thereof and guarding against the possibility of inadvertent rolling thereof when placed in a horizontal position on a relatively flat surface. The intermediate small and closely spaced ribs 25 are particularly useful to insure the stable retention during such operations as either loading or unloading an item or ordnance and the threaded engagement or separation of the mating halves of the container.

Figure 4:
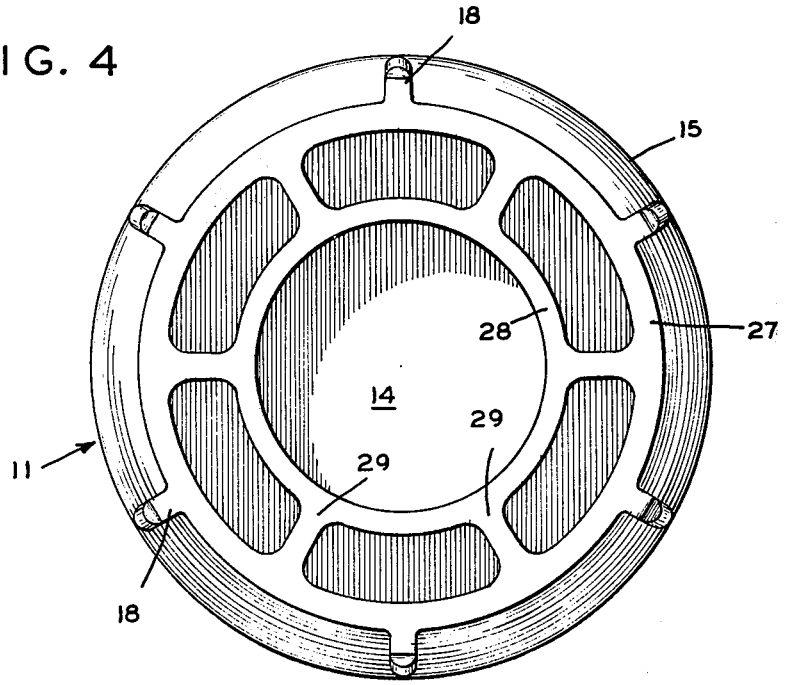
FIG. 4 is a top plan view thereof.

As shown more particularly in FIG. 4 of the drawings, the top surface of the upper portion 11 of the container is constituted by a pair of concentric annular ribs 27 and 28 united by diametrically opposed and uniformly spaced ribs 29. This arrangement provides a plurality of depressed surfaces with spaced air pockets and insures and guards against undue transmission of shock from a vertical direction to the container contents. For related reasons the interior surface of the top end wall 14 is provided with a centrally located and inwardly extending thickened portion 30 which presents a rounded surface to the adjacent extremity of the enclosed article of ordnance.

Figure 3:
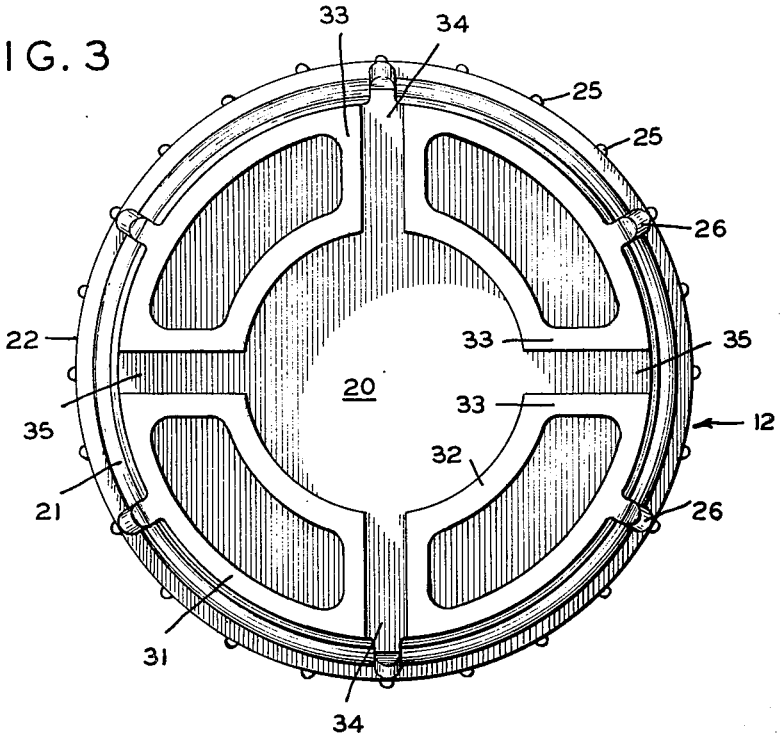
FIG. 3 is a bottom plan view of the container.

A comparable structural arrangement is provided in the bottom surface of the lower half 12 of the container where, as shown more particularly in FIG. 3 of the drawings the inner and outer concentric annular ribs 31 and 32 are segmental and the ends of adjacent segments are united by radially disposed connecting ribs 33. This provides at least two pairs of passages 34 and 35 extending across the bottom wall 20, exteriorly thereof, the passage 34 being disposed at right angles to the passage 35. The function of these passages is to permit the insertion therein of a bar-like tool whereby additional tightening pressure may be exerted when the mating halves of the container are to be assembled in closed relationship. Reversely, the same bar-like tool may be employed to assist in loosening the threaded engagement between the mating halves of the container to permit convenient separation for such purposes as loading, unloading and/or inspection of contents.

Figure 9:
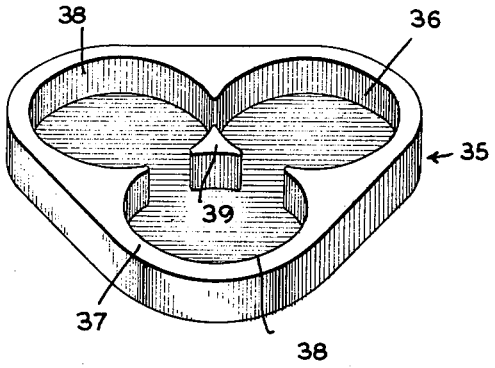
FIG. 9 is a perspective view of a novel jig required for the banding of three containers as a single unit.
Figure 10:
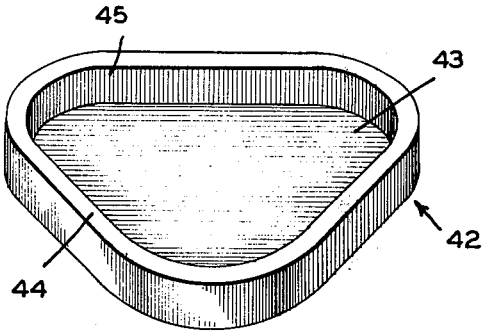
FIG. 10 is a perspective view, similar to FIG. 9, of a slightly modified form of jig.

For convenience, and to avoid the necessity for the individual handling of each container, a plurality thereof may be fastened together in groups for ready handling and special jigs as shown in FIGS. 9 through 12 of the drawings are contemplated for such purposes. Where three containers are to be assembled for handling as a unit, the form of jig illustrated in FIGS. 9 and 10 are applicable. Where assemblies or packages of either two or four containers are desired, the jigs of FIGS. 11 and 12 may be utilized.

Figure 8:
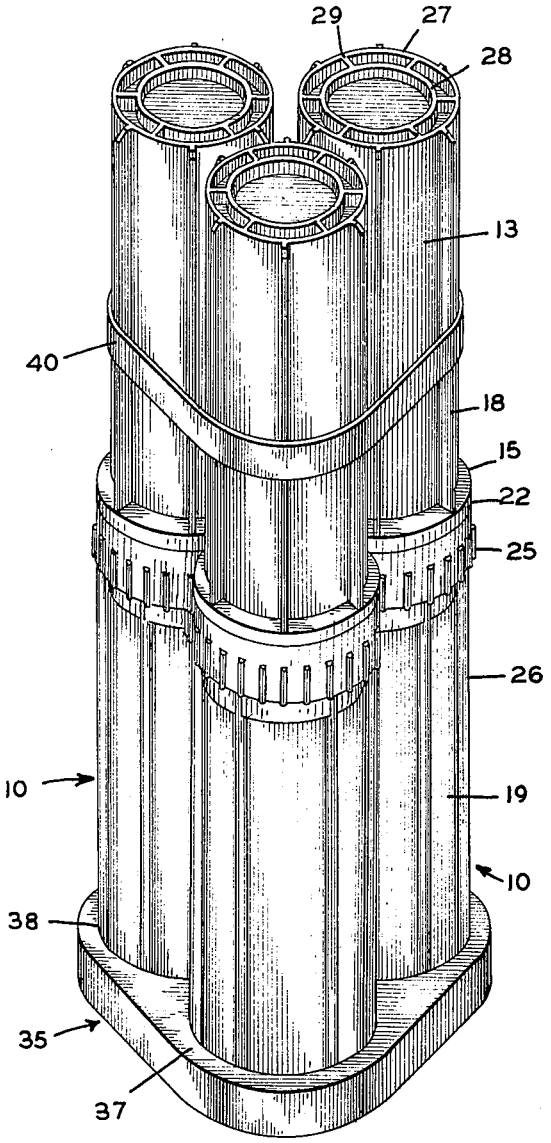
FIG. 8 is a perspective view illustrating the initial step in a novel method of securing three containers together in banded relationship as a single unit.

As shown more particularly in FIG. 9 of the drawings the jig 35 includes a substantially triangular flat base portion 36 and an upstanding peripheral wall 37. The interior surface of the peripheral wall 37 is specifically conformed to provide three uniformly spaced circular recesses or seats 38 each of which has a diameter complementary to the exterior diameter of the top or bottom of the container 10, it being understood that these exterior diameters are identical. Centrally of the base an upstanding substantially triangular projection 39 may be provided to assist in locating and stabilizing containers positioned within the jig 35. From an examination of FIG. 9 of the drawings it will be apparent that a substantially clover-leaf pattern is produced and three vertically disposed containers 10 may be placed upon and securely retained within the jig 35 with the enlarged centrally located portions 22 which constitute the upper extremities of the bottom portions of the containers in abutting relationship. A metallic strap or band 40 is then applied to the assembly, the location thereof being substantially midway of the upper portions of the containers. This is illustrated clearly in FIG. 8 of the drawings. It then is a simple matter to remove the banded group of containers from the jig 35, reverse the vertical disposition thereof and return the containers to the jig with the banded extremities down. A second band 41 is then affixed to the now upwardly projecting bottom halves of the container to complete the assembly as is illustrated in FIG. 6 of the drawings.

Assemblies thus banded can be handled with particular facility for such purposes as shipping, storage and convenience of us at missile sites for practice purposes or under combat conditions. Moreover the removal of the band at one end of an assembly will permit the convenient opening of a container when contents inspection is required.

The jig 42 of FIG. 10 is related to that illustrated in FIG. 9 and also is intended for use in the banding of threemissile assemblies. As shown, this form of jig also is substantially triangular and includes a flat base portion 43 and an upstanding peripheral wall 44 providing a single triangular recess 45 having arcuate corners and of a size complementary to that required for the reception of three vertically disposed containers arranged in abutting relationship, banding being accomplished in the identical manner set forth hereabove.

Figure 11:
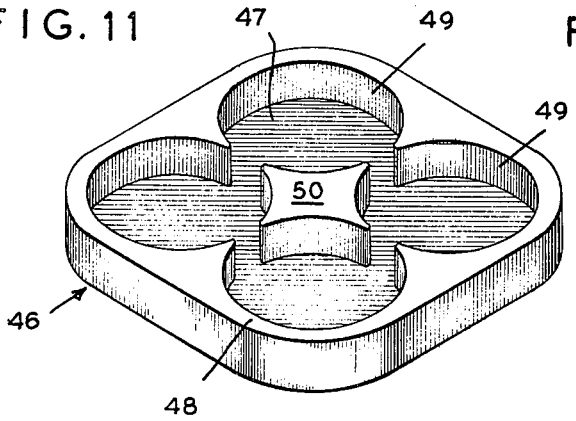
FIG. 11 is a perspective view of a novel jig designed for use in connection with the banding together of four containers.

The jig 46 illustrated in FIG. 11 of the drawings includes a substantially square flat base portion 47 and an upstanding peripheral wall 48. The interior surface of the peripheral wall is specifically conformed to provide four uniformly spaced circular recesses or seats 49 each of which has a diameter complementary to the exterior of the top or bottom of the container 10, it being understood that these exterior diameters are identical. Centrally of the flat base portion 47 an upstanding substantially rectangular projection 50 may be provided to assist in locating and stabilizing containers positioned within the jig 46. From an examination of FIG. 11 of the drawings it will be apparent that a substantially four-leaf clover pattern is produced and four vertically disposed containers 10 may be placed upon and securely retained within the jig 46 with the enlarged centrally located portions 22 which constitute the upper extremities of the bottom portions of the containers in abutting relationship. Banding of the ground containers is accomplished in the identical manner set forth hereabove. It will be understood that the closely spaced vertically disposed ribs 25 provided on the enlarged upper extremity 22 of each container function to preclude any possibility of independent rotative movement of an individual container whether during the banding operation or thereafter, the ribs 25 on adjacent containers serving as stops or locking means for such purposes.

The stability of the jig 46 is such that it can be utilized, if desired and with equal facility, for the banding of containers in groups of two (pairs) through the utilization of any two adjacent recesses or seats 49.

Figure 12:
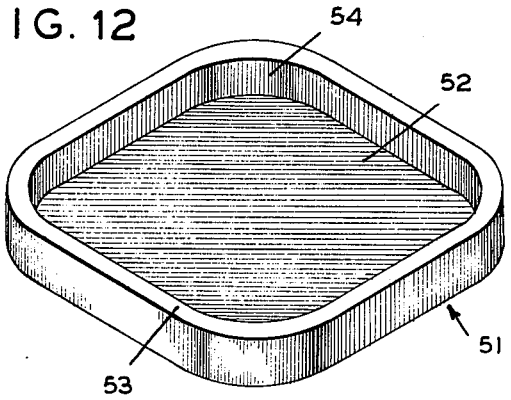
FIG. 12 is a perspective view, similar to FIG. 11, of a slightly modified form of jig.

The modified form of jig 51 illustrated in FIG. 12 of the drawings is related to that shown in FIG. 11 and also is intended for use in the banding of four-missile assemblies. This form of jig also is substantially square and includes a flat base portion 52 and an upstanding peripheral wall 53 providing a single substantially square recess 54 having arcuate corners and of a size complementary to that required for the reception of four vertically disposed containers 10 arranged in abutting relationship. If will be understood that the radius of the arcuate corners of the recess 53 is complementary to that of top or bottom portions of the container 10. With a group of four containers positioned within the jig 50, banding is accomplished in the identical manner set forth hereabove.

The mating halves 11 and 12 of the container preferably are produced by a molding operation from suitable thermoplastic material such as, for example, polyethylene, polypropylene, and the like. Thermosets, such as hard rubber, phenolics, etc., also may be employed.

Present day molding techniques make it possible to produce containers of the present invention to close tolerances whereby an assembled container will afford complete and virtually sealed protection for the enclosed projectile during shipment as well as periods of extended storage.

Among the essential characteristics required are weatherability including complete resistance to moisture and changing temperature conditions. Among the polyolefins which may be utilized for present purposes it has been found that crosslinkable polyethylene has improved weather resistance, high impact resistance, and increased stress crack resistance. A particularly suitable formula for present purposes, parts being indicated by weight, is:

| | |
|---|---|
| Resin | 100 parts |
| MT Black | 50 parts |
| Peroxide | 10 parts |
| Ferro ¼" Fiberglass | 40 parts |
| Zinc Stearate | 4 parts |

With the two halves of the container molded from polymeric material of the character with which we here are concerned, it has been discovered that mere threaded engagement therebetween is all that is required to insure that the interior and contents will become moisture proof and protected against adverse exterior influences. This is by reason of the nature of the polymeric material which provides a natural affinity between the top and bottom portions particularly at the area of contact (threaded engagement) and a blocking condition develops thereby requiring a greater force to separate the mating halves than was required to effect threaded engagement therebetween.

Either of the jigs illustrated and described, with three and four recesses, respectively, may be utilized with equal facility for the banding of containers in pairs constituting what may be termed a "2-container back pack". Such an arrangement will be particularly advantageous under combat or training conditions where using shoulder straps or the like, an individual may carry a pair of projectiles with relative convenience.

There has thus been described a novel container, particularly useful for the storage and shipment of projectiles and the like, which may be produced with particular economy and which will insure the protection of the contents against deterioration or other adverse influences during protracted periods of storage. Further, the novel method of banding such containers in multiples or groups facilitates the handling thereof and permits convenient periodic inspection of contents as may be required.

It will be obvious to those skilled in this art that various changes may be made in the invention without departing from the spirit and scope thereof and reference is had to the claims for summaries of the essentials of the invention, novel features thereof and novel combinations of parts for all of which protection is desired.

What is claimed is:

1. A shipping and storage container for items of ordnance, said container comprising top and bottom mating portions each of which includes a substantially cylindrical wall portion having an open mouth at the inner extremity thereof and a closed end wall at the outer extremity thereof; said top portion having an integral outwardly projecting peripheral rib spaced from the lower open extremity thereof, the end surface of said peripheral rib providing an abutment shoulder, the outer peripheral surface of said top portion including an externally threaded portion located intermediate said peripheral rib and said open mouth, and the outer peripheral surface of said top portion having a plurality of uniformly spaced longitudinally disposed ribs extending from said peripheral rib to the upper extremity of said top portion; said bottom portion having an outwardly flared portion spaced from the upper open extremity thereof and an integral upper extremity of increased diameter complementary to that of the peripheral rib on said upper portion, the end surface of said extremity of increased diameter contacting said abutment shoulder when said top and bottom mating portions are in assembled relationship thus limiting the extent of entry of the bottom portion into said top portion, said extremity of increased diameter being interiorly threaded for the reception of said complementarily externally threaded portion, the peripheral surface of said upper portion of increased diameter having a plurality of uniformly and closely spaced ribs located intermediate said outwardly flared portion and said open mouth, and the outer peripheral surface of said bottom portion having a plurality of uniformly spaced longitudinally disposed ribs extending from said outwardly flared portion to the lower extremity of said bottom portion.

2. A shipping and storage container as set forth in claim 1 where the outer surfaces of said end walls are constituted by a pair of concentric annular ribs united by a plurality of radially disposed connecting ribs providing a plurality of spaced air pockets therebetween.

3. A shipping and storage container as set forth in claim 2 where said radially disposed connecting ribs are located in diametrically opposed pairs.

4. A shipping and storage container as set forth in claim 3 where on at least one of said end walls the spaced pair of concentric annular ribs is segmental and the radially disposed connecting ribs define two pairs of transverse passages for insertion of a tool to assist selectively in the engagement or disengagement of the threaded relationship between the mating portions of the container.

5. A shipping and storage container as set forth in claim 4 where said mating portions are molded from polymeric material.

* * * * *

U.S. DEPARTMENT OF COMMERCE

PATENT OFFICE

Washington, D.C. 20231

UNITED STATES PATENT OFFICE

CERTIFICATE OF CORRECTION

Patent No. 3,439,967 April 22, 1969

William D. Taylor

It is certified that error appears in the above identified patent and that said Letters Patent are hereby corrected as shown below:

Column 3, line 20, cancel "a", second occurrence; line 26, "51" should read -- 51. --; line 45, "polystrene" should read -- polystyrene --; line 62, "connected" should read -- connect --; line 65, after "of" insert -- each --; line 71, cancel "a". Column 4, line 9, "retaining" should read -- retainer --.

Signed and sealed this 1st day of September 1970.

(SEAL)
Attest:

Edward M. Fletcher, Jr.
Attesting Officer

WILLIAM E. SCHUYLER, JR.
Commissioner of Patents